United States Patent [19]

Bourgeois

[11] 4,020,514

[45] May 3, 1977

[54] BOTTOM RELEASE MECHANISM FOR A SONOBUOY

[75] Inventor: Armand E. Bourgeois, Manchester, N.H.

[73] Assignee: Sanders Associates, Inc., South Nashua, N.H.

[22] Filed: Dec. 12, 1975

[21] Appl. No.: 640,115

[52] U.S. Cl. ..... 9/8 R

[51] Int. Cl.[2] ..... B63B 21/52

[58] Field of Search ..... 9/8 R; 220/323, 281; 340/2

[56] References Cited

UNITED STATES PATENTS

| | | | |
|---|---|---|---|
| 3,006,002 | 10/1961 | Pingree et al. | 9/8 R |
| 3,220,600 | 11/1965 | Wojciechowski et al. | 220/281 |
| 3,275,976 | 9/1966 | Farmer | 340/2 |

FOREIGN PATENTS OR APPLICATIONS

| | | | |
|---|---|---|---|
| 690,288 | 3/1965 | Italy | 9/8 R |

*Primary Examiner*—Trygve M. Blix
*Assistant Examiner*—Gregory W. O'Connor
*Attorney, Agent, or Firm*—Louis Etlinger; Robert K. Tendler

[57] ABSTRACT

A bottom release mechanism for a sonobuoy is provided in which a removable end cap is provided with a deformable detent member in the form of either a leaf spring or frangible member, which normally maintains a spring-loaded pin in locking engagement with the sonobuoy package thereby to lock the end cap in position at the bottom of the sonobuoy package. Upon water impact the deformable detent is deformed out of engagement with the spring loaded pin thereby releasing it which permits release of the end cap from the sonobuoy package. The use of the deformable detent member increases reliability of end cap release over large entrance angles of the dropped sonobuoy with respect to the surface of the ocean.

15 Claims, 10 Drawing Figures

BOTTOM RELEASE MECHANISM FOR A SONOBUOY

FIELD OF THE INVENTION

This invention relates to air dropped apparatus and more particularly to an improved end cap release mechanism involving the use of a deformable detent member.

BACKGROUND OF THE INVENTION

One of the largest problems involved with deployment of conventional air dropped sonobuoys is the release of apparatus carried in a sonobuoy package, once the sonobuoy has impacted the ocean and is floating on the surface of the ocean. It will be appreciated that sonobuoys depend upon submerged sensing apparatus and that this sensing apparatus must be released for the proper operation of the sonobuoy. While various sonobuoy end cap release mechanisms have been utilized in the past, one of the major problems with these mechanisms is the reliability of the release. Should the end cap not release, the sonobuoy is rendered inoperative. One of the factors affecting the reliability of the release of the end cap is the entry angle of the sonobuoy as it impacts the ocean surface. Various stabilizing apparatus such as parachutes and rotochutes have been utilized to maintain a vertical entry angle of the sonobuoy. However, in each of these configurations the sonobuoy swings during descent and may therefore enter the ocean at angles other than along the local vertical. Should this occur, those release mechanisms depending on impact pressure for the release of the end cap often fail.

One type prior art bottom release mechanism is illustrated in U.S. Pat. No. 3,275,976 issued to E.W. Farmer Sept. 27, 1966. In this patent a rigid detent member is moved in an upward direction upon impact of the sonobuoy thereby permitting the release of a spring loaded pin and the subsequent release of the end cap. While this device works satisfactorily for most entry angles there is a possiblity of the canting of the rigid detent against the side wall of the chamber in which it is located when the sonobuoy enters the ocean at a fairly oblique angle. When there is sufficient stabilization time, as in high-altitude sonobuoy drops, the Farmer device works quite adequately. However, in low altitude drops there may be insufficient time for the stabilization of the sonobuoy and the sonobuoy may enter the ocean surface at entry angles exceeding plus or minus 45° of the local vertical. In this situation it is possible for the pressure to be applied to the nondeformable rigid detent in such a way as to cause failure of this member.

The subject invention improves on the Farmer release mechanism by providing a deformable detent member for the release of the spring loaded pin. In one embodiment an outwardly-bowed or convex leaf spring member is provided with a slot or aperture which coacts with an annular flange or boss on the spring loaded pin. In normal operation the boss is located in the slot and the slot locks the pin against the spring loading so as to maintain the end cap securely fastened to the bottom of the sonobuoy package. Upon impact the flexible leaf spring is depressed at which time the slot comes out of engagement with the boss on the spring loaded pin and the spring loaded pin is then released, there by allowing the end cap to fall free from the sonobuoy package. The leaf spring is anchored at only one end, with the other end of the leaf spring being free to slide when the leaf spring is depressed by water impact. It is a finding of the subject invention that this configuration permits reliable release of the end cap regardless of the angle of entry of the sonobuoy assuming the sonobuoy does not land on its side or bottom up. In another embodiment the spring loaded pin is maintained in position by a frangible member which is deformed under impact and completely breaks up or disintegrates. The frangible member is so designed and positioned such that it locks the spring loaded pin against the spring loading until such time as the frangible member is broken by water impact. The frangible detent may, of course, take on any of a variety of forms and all such forms are within the scope of the present invention.

It will be appreciated that what has been provided is a releaseable end cap carrying a deformable detent member which is deformed upon water impact to release a spring loaded pin also carried by the end cap which then translates out of a locking engagement with the sonobuoy package to permit release of the end cap. By "deformable" is meant that the detent member is either flexed for displacement away from the spring loaded pin or is in fact destroyed thereby releasing the spring loaded pin.

It is therefore an object of this invention to provide an improved bottom release mechanism for air dropped sonobuoys and the like;

It is another object of this invention to provide a deformable detent member for use with a spring loaded locking mechanism for reliable release of end caps provided for air dropped apparatus;

It is a still further object of this invention to provide a deformable member in the form of either a deformable leaf spring or a frangible member which maintains a spring loaded locking member in locking engagement until such time as air dropped apparatus carrying this member impacts the surface of the ocean at which time the deformable member releases the spring loaded locking member.

These and other objects will be better understood from the remainder of the specification taken in conjuncton with the following drawings in which:

DETAILED DESCRIPTION

Figure 1:
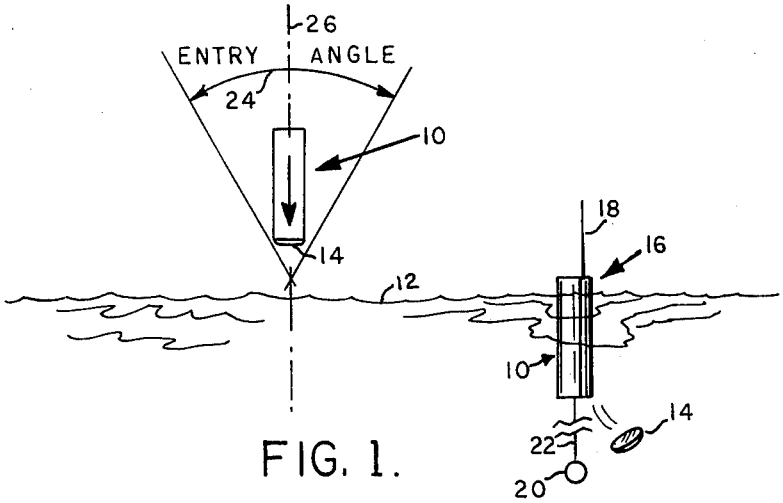
FIG. 1 is a diagrammatic representation of a sonobuoy impacting the surface of a body of water and thereafter floating at the surface of the body of water illustrating the sonobuoy entry angle and the deployment of subsurface apparatus carried by the sonobuoy.

Referring now to FIG. 1, air dropped apparatus such as a sonobuoy generally indicated by reference character 10 is illustrated immediately before impacting the surface 12 of a body of water such as the ocean. Sonobuoy 10 carries an end cap 14 which is to be released after impact and when the sonobuoy is floating at the surface of the ocean as illustrated at 16, with its antenna 18 oriented vertically. In this illustration end cap 14 has been released and submerged sonobuoy apparatus 20 is deployed from the sonobuoy via support means generally indicated by reference character 22.

It will be appreciated that for the successful operation of the sonobuoy the subsurface apparatus must be reliably deployed and the sonobuoy package must be floating at the surface of the ocean with its transmitting antenna extending thereabove. It is therefore a prerequisite for sonobuoy operation that the end cap reliably released. In the past, in order to assure reliable release of the end cap the sonobuoy must impact the surface of the ocean in a relatively narrow entry angle generally indicated by the double ended arrow 24 centered about the local vertical indicated by the dotted reference line 26. It was generally acknowledged that reliable release could be obtained if the entry angle was kept to a maximum of ±20° of the local vertical. However, in practice with present descent limiting devices such as parachutes or rotochutes, maintaining this relatively narrow entry angle was difficult due to the generally pendulous swinging motion of the sonobuoy as it descended. Should the sonobuoy exceed this rather limited entry angle various prior art end cap release mechanisms could fail due to the oblique forces exerted on the end cap upon impact.

Figure 2:
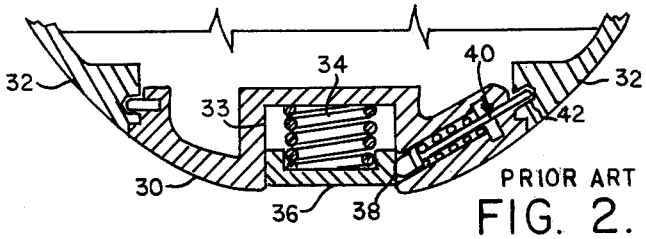
PRIOR ART FIG. 2.
FIG. 2 is a sectional diagram of a prior art bottom release mechanism showing a nondeformable detent member for releasing a spring biased locking member.

One type of prior art releaseable end cap which has been particularly successful in the past is illustrated in FIG. 2. In this Figure, end cap 30 is releaseably attached to bottom walls 32 of a sonobuoy package. End cap 30 is provided with a chamber 33 generally housing a spring member 34 which coacts with a rigid detent means 36, in one embodiment a piston-like member. A wall 38 of detent means 36 maintains a spring loaded pin structure generally indicated by reference character 40 in a pin cavity 42 to lock the end cap to the sonobuoy housing.

Upon water impact rigid detent means 36 moves upwardly in a vertical direction thereby releasing the spring biased pin structure 40 which releases the end cap for deploying sonobuoy apparatus located thereabove.

While this type releaseable end cap apparatus functions well there is the possibility that the rigid detent member may cant within its chamber thereby preventing release of the end cap. This occurs most noticeably at very large entrance angles.

Figure 3:
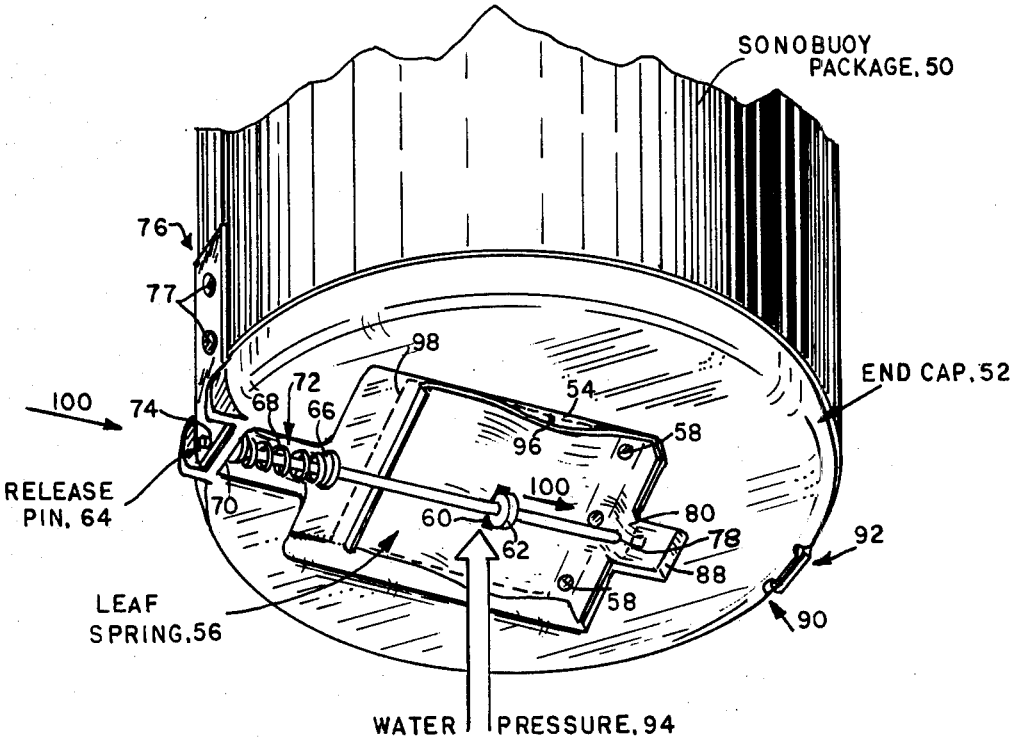
FIG. 3 is a diagrammatic representation of one embodiment of the subject invention illustrating a deflectable notched leaf spring member used in conjunction with a spring loaded release pin.

Referring now to FIG. 3, the subject invention replaces the rigid detent means with a deformable detent means, whose movement is not limited by side walls. In one embodiment, a sonobuoy package or housing generally indicated by reference character 50 having a portion adapted to impact a body of water is provided with an end cap 52 located at this portion and recessed portion 54 in which is located deformable detent means, in this case, a leaf spring 56. It will be appreciated that the recessed portion is not necessary to the operation of this invention and may be omitted.

This leaf spring is anchored in the recessed portion at one end via rivets 58 or the like and is provided with a centrally located slot or aperture 60 which cooperates with an annular ring or boss 62 fixedly attached to a spring biased release member in the form of a pin 64 mounted for translation on the end cap. A second fixedly attached ring or boss 66 is mounted on release pin 64 and a spring generally indicated at 68 is carried coaxially about the pin between a wall 70 through which it passes and boss 66. Release pin 64 lies in a channel generally indicated by reference character 72 which communicates with recessed portion 54 and extends in its armed or locked position to the exterior side of wall 70 where it penetrates an aperture 74 in a vertically extending end cap retaining member 76 fixedly attached to sonobuoy package 50 by rivets 77 or the like. The other end of the release pin goes through an aperture 78 through a vertically extending end portion 80 of leaf spring 56 and penetrates into a cavity 88 of sufficient length for the translation of the release pin. In this manner, one side of end cap 52 is releaseably secured to the corresponding side of the sonobuoy package. The other side of the release cap generally indicated by reference character 90 is releaseably secured to the corresponding side of the sonobuoy package via a tongue and groove, or tab/slot structure generally indicated by reference character 92.

In operation, upon impact, water pressure generally indicated by arrow 94 coacts to depress leaf spring 56 as illustrated by arrow 96 so that the leaf spring assumes position illustrated by dotted outline 98. When this occurs slot or aperture 60 is moved out of engagement with boss 62 thereby permitting release pin 64 to translate in the direction of arrows 100, thereby to come out of engagement with aperture 74 in member 76.

Figure 4A:
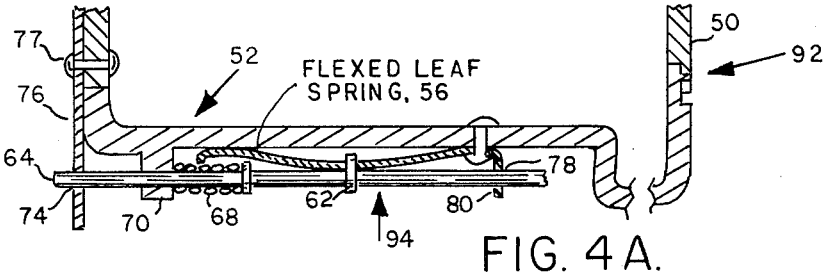
FIGS. 4A and 4B are sectional diagrams illustrating the operation of the release mechanism of FIG. 3.
Figure 4B:
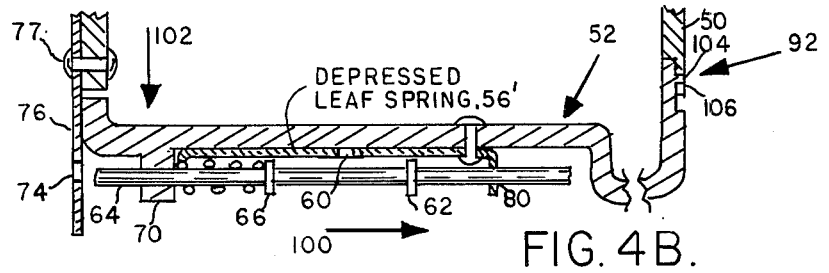
Figure 5:
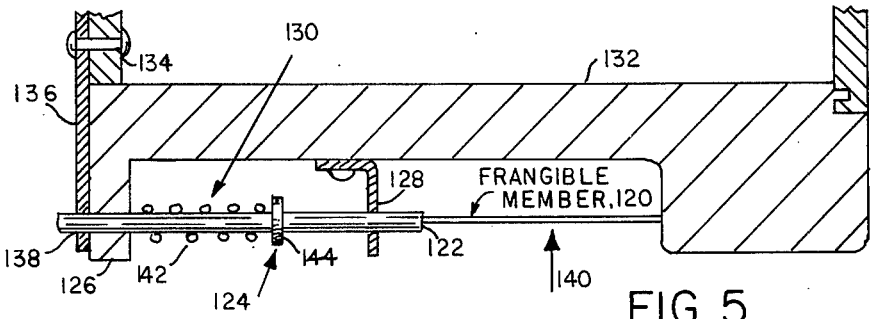
FIG. 5 is a sectional diagram illustrating the utilization of a frangible member for the maintaining of a spring loaded locking member in a locked position until such time as the sonobuoy or other apparatus impacts the surface of the ocean.

This operation is illustrated in more detail in connection with FIGS. 4A and 4B in which members in FIGS. 4A and 4B are given the same reference characters as corresponding members in FIG. 3. In this series of sectional diagrams it will be appreciated that the flexed leaf spring 56 in the position shown in FIG. 4A cooperates with boss 62 to prevent the movement of release pin 64 to the right. Upon impact, leaf spring 56 is depressed as illustrated by reference character 56′ in FIG. 4B, such that pin 64 moves to the right out of aperture 74 thereby permitting the downward movement of end cap 52 as illustrated by arrow 102. It will be appreciated that once the sonobuoy has impacted, the sonobuoy buoyance maintains the sonobuoy at the surface of the ocean, whereas subsurface apparatus resting on end cap 52 forces end cap 52 in the direction of arrow 102. Alternatively, end cap 52 may be spring biased downwardly by conventional spring biasing means (not shown). In either case by the downward movement of one side of the cap, a tab 104 at the other side of the cap is moved out of corresponding slot or aperture 106 and the end cap falls away from the sonobuoy package.

It will be appreciated that the leaf spring will not bind during depression and thus, the subject end cap release mechanism is exceptionally reliable even when the sonobuoy impacts at very large entrance angles. The form of the deformable detent member need not be limited, however, to leaf spring apparatus.

Referring now to FIGS. 5–9, the deformable detent apparatus may take the form of a frangible member generally indicated by reference character 120 interposed between an end 122 of a spring loaded pin member generally indicated by reference character 124 and described more fully hereinbefore. This frangible member may be made of ceramic material, glass, plastic, etc. or generally of any material which will shatter under impact. The release pin structure is illustrated as being translatably suspended between an integral wall 126 and a support 128 both of which are apertured to receive a portion of the pin in slideable engagement. As mentioned hereinbefore, the pin may be located within a recessed portion 130 of a releaseable end cap 132. Fixedly attached to a sidewall 134 of the sonobuoy package is an apertured member 136 with an aperture 138 through which the release pin protrudes.

In operation, water pressure generally indicated by arrow 140 exerts sufficient pressure on frangible member 120 to break frangible member 120 thereby releasing the pressure on end 122 of release pin assembly 124 such that spring 142 coacts with boss 144 to move the pin to the right out of engagement with aperture 138.

Figure 6:
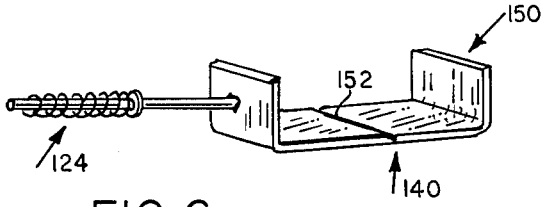
FIG. 6 is a diagrammatic illustration of one type frangible member in the form of a scored U-shaped frangible member.

The shape of the frangible member as illustrated in FIG. 6 may take on a generally U-shaped configuration 150 with a laterally extending slot portion 152 which permits the breaking of the frangible member easily upon water impact. The slot may be merely a scoring of the surface of the frangible member.

Figure 7:
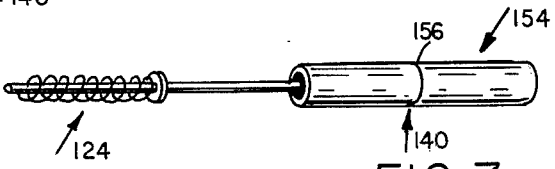
FIG. 7 is a diagrammatic illustration of a tubular scored frangible member utilized in combination with a spring loaded pin member.
Figure 8:
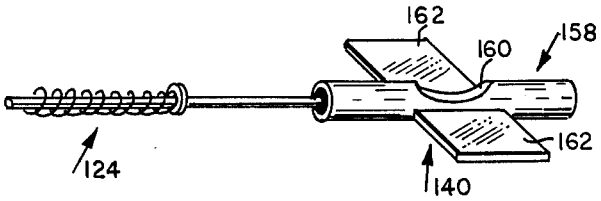
FIG. 8 is a diagrammatic illustration of a tubular and notched frangible member having laterally extending pressure plates for use in connection with a spring loaded pin member.

Referring to FIG. 7 the frangible member may be a scored tube 154, with the scoring as illustrated at 156. Alternatively, as illustrated in FIG. 8, the frangible member may be a tube 158 with a hollowed out portion 160 and integrally formed pressure plates 162 extending laterally to increase the impact water pressure on the tube and thereby assure the breaking of the frangible member.

Figure 9:
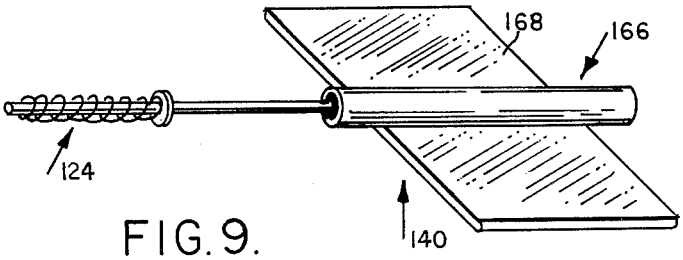
FIG. 9 is a diagrammatic representation of a tubular frangible member for use with another type of pressure plate apparatus also in combination with a spring loaded pin member.

As illustrated in FIG. 9, a frangible tubular member 166 may be provided with a nonintegral pressure plate 168 located at its bottom surface for exerting pressure on the tube to break it upon impact, regardless of whether the tube is scored or weakened as previously described.

What has therefore been described is the combination of a spring biased release pin with a deformable detent member for reliably releasing the pin and therefore an end cap upon impact of an air dropped sonobuoy or the like with the surface of the ocean. It will be appreciated that while the subject invention has been described in connection with the air dropped sonobuoys it may be utilized with any apparatus which impacts the surface of the ocean or a body of water where releaseable end caps are desired, and wherein the apparatus is pointed in a downward direction either by virtue of descent limiting apparatus or by virtue of the weight distribution within the apparatus.

Although a specific embodiment to the invention has been described in considerable detail for illustrative purposes, many modifications will occur to those skilled in the art. It is therefore desired that the protection afforded by Letters Patent be limited only by the true scope of the appended claims.

What is claimed is:

1. Apparatus adapted to impact a body of water comprising:
   - a housing having a portion adapted to impact said body of water;
   - an end cap located at the portion of said housing adapted to impact said body of water;
   - an end cap retaining member fixedly attached to said housing and depending from the portion adapted to impact said body of water;
   - a spring biased release member mounted for translation on said end cap; said release member in one position operably engaging said end cap retaining member in a locking relationship to lock said end cap to said housing;
   - an abutment at said end cap; and,
   - a deformable detent meber positioned between a portion of said spring biased release member and said abutment, said deformable detent member exerting a force on said spring biased release member in a direction opposite to the direction of spring biasing to maintain said locking relationship in one position and to unlock said spring biased release member upon deformation, whereby when said end cap impacts said body of water said deformable detent member moves out from between said portion of said spring biased release member and said abutment, thereby to release said spring biased release member from locking engagement with said end cap retaining member to release said end cap.

2. The apparatus of claim 1 wherein said deformable member includes a convexly bowed leaf spring having an aperture therein, means for fixedly attaching one end of said leaf spring to said end cap, and further including boss means fixedly attached to said spring biased release member and adapted to cooperate with the aperture in said leaf spring to maintain said spring biased release member in said locking relationship.

3. The apparatus of claim 1 wherein said deformable detent member includes a frangible member.

4. The apparatus of claim 3 wherein said frangible member includes a U-shaped member.

5. The apparatus of claim 4 wherein said U-shaped member is scored transversely at the bottom of the U.

6. The apparatus of claim 3 wherein said frangible member is a tubular member.

7. The apparatus of claim 6 wherein said tubular member is weakened about its periphery.

8. The apparatus of claim 6 wherein said tubular member includes a hollowed-out portion between the ends thereof.

9. The apparatus of claim 6 and further including laterally extending pressure developing means located adjacent said tubular member.

10. The apparatus of claim 1 wherein said spring biased release member is a spring biased pin.

11. In combination:
   - a housing;
   - an end cap located at one end of said housing;
   - an end cap retaining member fixedly attached to said housing and depending from said one end;
   - a spring biased release member mounted for translation on said end cap; said release member in one position operably engaging said end cap retaining member in a locking relationship to lock said end cap to said housing;

an abutment at said end cap; and, a deformable detent member positioned between a portion of said spring biased release member and said abutment, said deformable detent member exerting a force on said spring biased release member in a direction opposite to the direction of the spring biasing to maintain said locking relationship in one position and to unlock said spring biased release member upon deformation.

12. A method of assuring reliable release of an end cap carried by a sonobuoy over large entry angles comprising the steps of:

providing the housing of said sonobuoy with an end cap located at the portion of said housing adapted to impact a body of water, an end cap retaining member fixedly attached to said housing and depending from the portion adapted to impact said body of water, a spring biased release member mounted for translation on said end cap, said release member in one position operably engaging said end cap retaining member in a locking relationship to lock said end cap to said housing, an abutment at the end cap and a deformable detent member positioned between a portion of said spring biased release member and said abutment, said deformable detent member exerting a force on said spring biased release member in a direction opposite to the direction of the spring biasing to maintain said locking relationship in one position and to unlock said spring biased release member upon deformation, ejecting said sonobuoy above said body of water and, stabilizing the descent of said sonobuoy so that said end cap impacts the surface of said body of water, whereby when said end cap impacts said body of water said deformable detent member moves out from between said portion of said spring biased release member and said abutment, thereby to release said spring biased release member from locking engagement with said end cap retaining member to reliably release said end cap.

13. The method of claim 12 wherein said deformable detent member includes a convexly bowed leaf spring having an aperture therein, means for fixedly attaching one end of said leaf spring to said end cap, and further including boss means fixedly attached to said spring biased release member and adapted to cooperate with the aperture in said leaf spring to maintain said spring biased release member in said locking relationship.

14. Apparatus adapted to impact a body of water comprising:

a housing having a portion adapted to impact said body of water;

an end cap located at the portion of said housing adapted to impact said body of water;

an end cap retaining member fixedly attached to said housing and depending from the portion adapted to impact said body of water;

a spring biased release member mounted for translation on said end cap; said release member in one position operably engaging said end cap retaining member in a locking relationship to lock said end cap to said housing; and, deformable detent means cooperating with said spring biased release member to maintain said locking relationship in one position and disengaging said spring biased release member upon deformation, whereby when said end cap impacts said body of water said deformably detent means moves out of engagement with said spring biased release member, thereby to release said spring biased release member from locking engagement with said end cap retaining member to release said end cap, said deformable detent means including a convexly bowed leaf spring having an aperture therein, means for fixedly attaching one end of said leaf spring to said end cap, and further including boss means fixedly attached to said spring biased release member and adapted to cooperate with the aperture in said leaf spring to maintain said spring biased release member in said locking relationship.

15. A method of assuring reliable release of an end cap carried by a sonobuoy over large entry angles comprising the steps of:

providing the housing of said sonobuoy with an end cap located at the portion of said housing adapted to impact a body of water, an end cap retaining member fixedly attached to said housing and depending from the portion adapted to impact said body of water, a spring biased release member mounted for translation on said end cap, said release member in one position operably engaging said end cap retaining member in a locking relationship to lock said end cap to said housing, and deformable detent means cooperating with said spring biased release member to maintain said locking relationship in one position and disengaging said spring biased release member upon deformation, said deformable detent means including a convexly bowed leaf spring having an aperture therein, means for fixedly attaching one end of said leaf spring to said end cap, and further including boss means fixedly attached to said spring biased release member and adapted to cooperate with the aperture in said leaf spring to maintain said spring biased release member in said locking relationship, ejecting said sonobuoy above said body of water and, stabilizing the descent of said sonobuoy so that said end cap impacts the surface of said body of water, whereby when said end cap impacts said body of water said deformably detent means moves out of engagement with said spring biased release member, thereby to release said spring biased release member from locking engagement with said end cap retaining member to reliably release said end cap.

* * * * *